US007971988B2

(12) United States Patent
Nakashima

(10) Patent No.: US 7,971,988 B2
(45) Date of Patent: Jul. 5, 2011

(54) IMAGE FORMING APPARATUS

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 201 days.

(21) Appl. No.: 11/363,156

(22) Filed: Feb. 28, 2006

(65) Prior Publication Data

US 2006/0192832 A1 Aug. 31, 2006

(30) Foreign Application Priority Data

Feb. 28, 2005 (JP) ..... 2005-053435

(51) Int. Cl.
*B41J 2/01* (2006.01)

(52) U.S. Cl. ..... 347/104; 347/101

(58) Field of Classification Search ..... 347/101–107; 399/101; 400/578, 587
See application file for complete search history.

(56) References Cited

U.S. PATENT DOCUMENTS

| | | | | |
|---|---|---|---|---|
| 5,568,244 | A | 10/1996 | Hirai et al. | |
| 5,867,197 | A * | 2/1999 | Aoki | 347/106 |
| 6,030,674 | A | 2/2000 | Onishi et al. | |
| 6,277,457 | B1 | 8/2001 | Onishi et al. | |
| 2003/0128253 | A1 * | 7/2003 | Kitahara et al. | 347/42 |
| 2004/0113973 | A1 | 6/2004 | Nakashima | |
| 2004/0183879 | A1 * | 9/2004 | Nakazawa | 347/101 |
| 2004/0228669 | A1 * | 11/2004 | Nakashima et al. | 400/635 |
| 2006/0132575 | A1 * | 6/2006 | Fukuda | 347/104 |

FOREIGN PATENT DOCUMENTS

| | | |
|---|---|---|
| JP | 20 86475 | 3/1990 |
| JP | H02-086475 A | 3/1990 |
| JP | H05-162881 A | 6/1993 |
| JP | 7 225521 | 8/1995 |
| JP | 8 310080 | 11/1996 |
| JP | H10-167518 A | 6/1998 |
| JP | 2003-182900 A | 7/2003 |
| JP | 2004-114406 A | 4/2004 |

OTHER PUBLICATIONS

European Patent Office, European Search Report for Related EP Application No. 06250770 dated Jul. 27, 2006.
Japan Patent Office; Office Action in Japanese Patent Application No. 2005-053435 (counterpart to the above-captioned U.S. patent application) mailed Jan. 6, 2010.
Japan Patent Office; Office Action in Japanese Patent Application No. 2005-053435 (counterpart to the above-captioned U.S. patent application) mailed Apr. 13, 2010.

* cited by examiner

*Primary Examiner* — Laura E Martin
(74) *Attorney, Agent, or Firm* — Baker Botts L.L.P.

(57) ABSTRACT

In a state that a termination edge of a recording medium aligns with a termination edge of a region opposing a recording head (nozzle surface), a sticking force acting on the recording medium is set to be at least equal to or greater than the weight of a part (a portion having a length) of the recording medium protruding from a separation start position toward the downstream side in a conveying direction.

4 Claims, 5 Drawing Sheets

IMAGE FORMING APPARATUS

CROSS-REFERENCE TO RELATED APPLICATIONS

This Nonprovisional application claims priority under 35 U.S.C. §119(a) on Patent Application No. 2005-053435 filed in Japan on Feb. 28, 2005, the entire contents of which are hereby incorporated by reference.

BACKGROUND

The present invention relates to an image forming apparatus and, in particular, to an image forming apparatus capable of preventing that the rear part of a recording medium in the conveying direction contacts with a nozzle surface of a recording head.

A line type printer comprises mainly: an endless conveyance belt for conveying a recording medium; a driven roller and a driving roller around which a conveyance belt is wound; and driving means for driving the driving roller. Then, a driving force generated by the driving means is transmitted to the conveyance belt via the driving roller so that the recording medium is conveyed by the conveyance belt. At the same time, ink is ejected from a recording head so that a desired image is formed on the recording medium.

In this line type printer, recording mediums can successively be fed from a paper feed unit onto the conveyance belt so that high-speed printing is achieved. Nevertheless, in order that accuracy should be ensured in the ink impact, the gap need be remarkably small between the recording head and the recording medium. This has caused a problem that when the conveyance belt rotates at high speed, vibrations in the conveyance belt generates fluctuation in the gap between the recording medium and the recording head, and thereby degrades the image quality.

In contrast, Japanese Patent Application Laid-Open No. 2-86475 (1990) discloses a technique in which a support member for causing a belt (conveyance belt) portion opposing the recording head to be supported on the opposite side of the recording head is provided on the inner periphery surface side of the belt. According to this technique, even when the belt rotates at high speed, vibrations in the belt are suppressed by the support member so that the generation of said gap fluctuation is suppressed.

SUMMARY

Here, in this conventional image forming apparatus, the recording paper (recording medium) which has passed the surface opposing the recording head so that a desired image has been formed thereon naturally separates from the conveyance belt at the position of the belt driving roller on the downstream side in the conveying direction, and then discharged to a paper discharge tray (paper discharge unit) by means of a conveyance force of the conveyance belt and the self-weight of the recording paper.

Nevertheless, the conventional image forming apparatus described above has had a problem that, when the recording medium is discharged from the conveyance belt to the paper discharge unit, the weight of the front part of the recording medium in the conveying direction having separated from the conveyance belt causes the rear part of the recording medium in the conveying direction to separate from the conveyance belt and thereby leap up, so that the rear part thereof in the conveying direction contacts with the nozzle surface of the recording head.

Therefore, in order to solve the above-mentioned problem, and it is an object to provide an image forming apparatus capable of preventing that the rear part of a recording medium in the conveying direction contacts with a nozzle surface of a recording head.

In order to achieve this object, an image forming apparatus according to the first aspect is an image forming apparatus comprising: an endless conveyance belt having an outer periphery surface which serves as a conveyance surface for a recording medium; and a recording head for ejecting ink onto a recording medium from a nozzle surface opposing the conveyance surface of said conveyance belt, wherein the recording medium retained on the conveyance surface of said conveyance belt is discharged to a discharge unit by means of a conveyance force thereof, characterized in that a sticking layer for sticking to the recording medium is formed on the outer periphery surface of the conveyance belt, and until the termination edge of the recording medium conveyed on the conveyance belt at least passes a region opposing the nozzle surface of the recording head, a sticking force exerted from the sticking layer of the conveyance belt onto the recording medium is set to be greater than the weight of a part of the recording medium protruding from the termination edge of the retaining portion that retains the recording medium, to downstream side in a conveying direction.

In the image forming apparatus according to the first aspect, a sticking layer for sticking to the recording medium is formed on the outer periphery surface of the conveyance belt, so that until the termination edge of the recording medium conveyed on the conveyance belt at least passes a region opposing the nozzle surface of the recording head, the sticking force exerted from the sticking layer of the conveyance belt onto the recording medium is set to be greater than the weight of a part of the recording medium protruding from the termination edge of the retaining portion that retains the recording medium, toward the downstream side in the conveying direction.

That is, when the recording medium is discharged from the conveyance belt to the discharge unit, until the termination edge of the recording medium at least passes the region opposing the nozzle surface of the recording head, the sticking force of the sticking layer which acts on the rear part of the recording medium in the conveying direction can support the weight of a part (front part in the conveying direction) of the recording medium protruding from the termination edge of the retaining portion.

This prevents that the rear part of the recording medium in the conveying direction separates from the conveyance belt and thereby leaps up owing to the weight of the front part of the recording medium in the conveying direction, and hence avoids that the rear part of the recording medium contacts with the nozzle surface of the recording head. As a result, an effect is achieved that that such troubles are prevented in advance that an ink blot occurs in the recording medium and that clogging arises in the nozzles.

The above and further objects and features will more fully be apparent from the following detailed description with accompanying drawings.

DETAILED DESCRIPTION OF THE EXEMPLARY EMBODIMENTS

Figure 1:
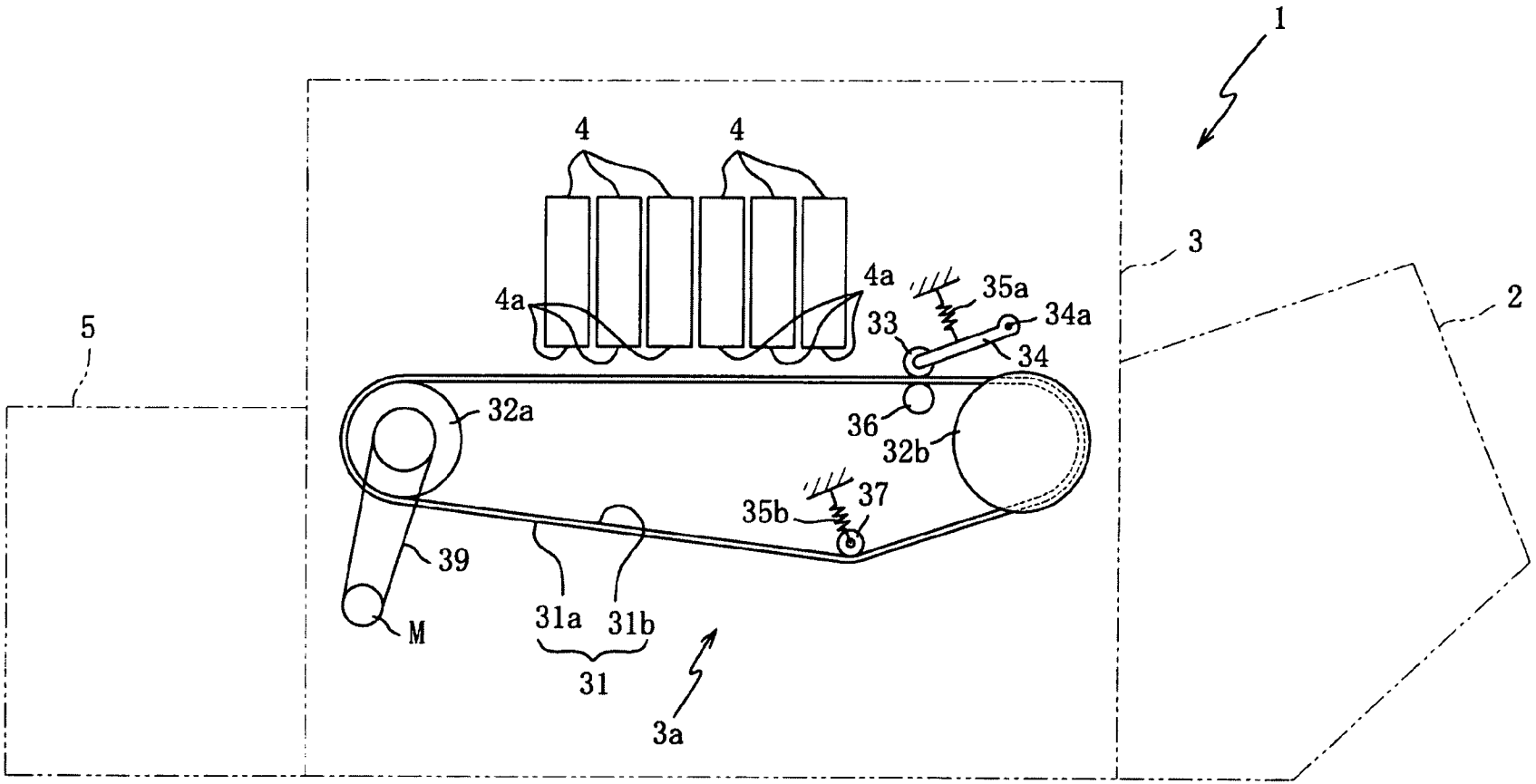
FIG. 1 is a schematic diagram of an image forming apparatus according to a first embodiment.

Preferred embodiments are described below with reference to the accompanying drawings. FIG. 1 is a schematic diagram of an image forming apparatus 1 according to a first embodiment. It should be noted that in FIG. 1, compression springs 35*a* and 35*b* are simplified while a supply unit 2 and a discharge unit 5 are schematically shown using double-dotted dashed lines.

First, the general configuration of an image forming apparatus 1 is described below with reference to FIG. 1. The image forming apparatus 1 is constructed as a so-called line type printer, and comprises mainly: a supply unit 2 for supplying a recording medium P (see FIG. 2) to a main body 3; the main body 3 for forming an image on the recording medium P supplied from the supply unit 2; and a discharge unit 5 for accommodating the recording medium P discharged from the main body 3.

The supply unit 2 comprises: a tray for accommodating the recording medium P; and a pickup roller for coming into contact with the recording medium P accommodated in the tray (both are not shown). The recording medium P in the tray is supplied sheet by sheet to a conveying unit 3*a* of the main body 3 when the pickup roller is driven to rotate.

In the conveying unit 3*a*, a recording medium conveyance path is formed for conveying the recording medium P supplied from the supply unit 2, toward the discharge unit 5. The recording medium conveyance path is constructed mainly from an endless conveyance belt 31 wound around a driving roller 32*a* and a driven roller 32*b*.

An outer periphery surface 31*a* of the conveyance belt 31 (i.e., the surface for retaining and conveying the recording medium P) is subjected to silicone treatment so that a sticking layer is formed. Thus, with retaining the recording medium P by means of the adhesive force, the conveyance belt 31 rotates in accordance with a rotational driving force transmitted from the driving roller 32*a* (in a counterclockwise direction in FIG. 1), and thereby conveys the recording medium P supplied from the supply unit 2 on the upstream side in the conveying direction (right side in FIG. 1), toward the discharge unit 5 on the downstream side in the conveying direction (left side in FIG. 1).

Here, the driving roller 32*a* is rotated by a rotational driving force of a drive motor M transmitted via a transmission belt 39. Further, in the present embodiment, the outer periphery surface 31*a* of the conveyance belt 31 is subjected to silicone treatment so that a sticking layer is formed.

On the upstream side of the recording medium conveyance path (right side in FIG. 1), as shown in FIG. 1, a nip roller 33 and an encoder roller 36 oppose to each other with nipping the conveyance belt 31 positioned therebetween. Further, a tension roller 37 is arranged under the encoder roller 36 (lower side in FIG. 1).

The nip roller 33 is a rotating member for pressing the recording medium P against the conveyance belt 31 and thereby preventing the recording medium P from being floated. The nip roller 33 contacts with the outer periphery surface 31*a* of the conveyance belt 31. Further, the encoder roller 36 is a rotating member for rotating in conjunction with the conveyance belt 31 and thereby detecting the conveying speed of the conveyance belt 31. The encoder roller 36 contacts with the inner periphery surface 31*b* of the conveyance belt 31.

The nip roller 33 is pivotally supported by an arm portion 34 in a rotatable manner, and biased in a direction approaching the encoder roller 36 (downward in FIG. 1). That is, as shown in FIG. 1, a compression spring 35*a* in a compressed state is connected to the arm portion 34 capable of swinging about the shaft 34*a*. Thus, the elastic restoring force of the compression spring 35*a* biases the nip roller 33 downward in FIG. 1.

As such, in addition to detecting the conveying speed of the conveyance belt 31, the encoder roller 36 serves also as a pinching roller for supporting the nip roller 33. This reduces the number of components, and hence provides the effect of reduction in the component cost and the assembling cost. As a result, the overall product cost is reduced in the image forming apparatus 1.

Further, since the compression spring 35*a* biases the nip roller 33, the encoder roller 36 need not be constructed in a manner freely movable in the biasing direction or the opposite. This simplifies the structure for retaining the encoder roller 36, hence improves the reliability, and hence permits more accurate detection of the conveying speed of the conveyance belt 31.

The tension roller 37 is a member for providing a tension to the conveyance belt 31 and preventing vibrations in the conveyance belt 31. The tension roller 37 contacts with the inner periphery surface 31*b* of the conveyance belt 31, and is pivotally supported in a manner such as to rotate in conjunction with the conveyance belt 31. Further, the tension roller 37 is arranged on a side approaching the driven roller 32*b* rather than the driving roller 32*a* (right side in FIG. 1).

Here, a compression spring 35*b* in a compressed state is connected to the tension roller 37. Thus, the elastic restoring force of the compression spring 35*b* biases the tension roller 37 from the inner periphery surface 31*b* side of the conveyance belt 31 toward the outer periphery surface 31*a* side.

Further, in the present embodiment, the outer periphery surface of the tension roller 37 is made of an elastic material. Thus, a vibration suppressing effect of this elastic material suppresses vibrations in the conveyance belt 31.

Here, employable elastic materials include rubber-based elastic materials and urethane resin. For example, when a material such as a rubber-based elastic material having a viscous effect is employed, the viscous effect and the vibration suppressing effect provide a vibration damping function and a vibration isolating function, so that vibrations are damped in the conveyance belt 31 while the vibrations in the conveyance belt 31 are prevented from being transmitted to the body frame 30 (see FIG. 2) via the tension roller 37.

Over the conveyance belt 31 (upper side in FIG. 1), a plurality of (six, in the present embodiment) recording heads 4 are arranged in the conveying direction for the recording medium P. Each of the recording heads 4 is constructed in the shape of an elongate rectangular parallelepiped, and is arranged such that its longitudinal direction should be the width direction of the recording medium P (direction perpendicular to the page surface in FIG. 1).

A large number of nozzles for ejecting ink are formed in the bottom face (nozzle surface) 4*a* of the recording head 4. Each of the six recording heads 4 ejects ink of a distinct color selected from cyan, light cyan, magenta, light magenta, yellow, and black.

A predetermined gap is formed between the nozzle surfaces 4*a* of the recording heads 4 and the conveyance belt 31. The recording medium P passes through this gap. Then, when the recording medium P passes under the nozzles (lower side in FIG. 1), ink is ejected toward the upper surface of the recording medium P so that a desired color image is formed on the recording medium P.

Here, when ink is ejected from each of the recording heads 4, the timing of ejection of the ink is controlled on the basis of the conveying speed of the conveyance belt 31 detected by the encoder roller 36.

Further, in the present embodiment, the recording heads 4 are constructed in a manner permitting vertical motion (vertical direction in FIG. 1). Thus, at the time of maintenance, maintenance means (such as a cap and a pump for a purge operation which are not shown) can be arranged between the opposing surfaces of the recording heads 4 (nozzle surfaces 4*a*) and the conveyance belt 31.

The discharge unit 5 accommodates and retains in a stacked manner the recording mediums P discharged from the conveying unit 3*a*. That is, on completion of image formation onto the recording medium P by means of ejection of the ink from the recording heads 4, the recording medium P naturally separates from the conveyance belt 31 at a separation start position S (see FIG. 3) corresponding to the point where the conveyance belt 31 changes from a planar state into a curved state, and then discharged to the discharge unit 5 in association with the conveyance force of the conveyance belt 31.

Figure 2:
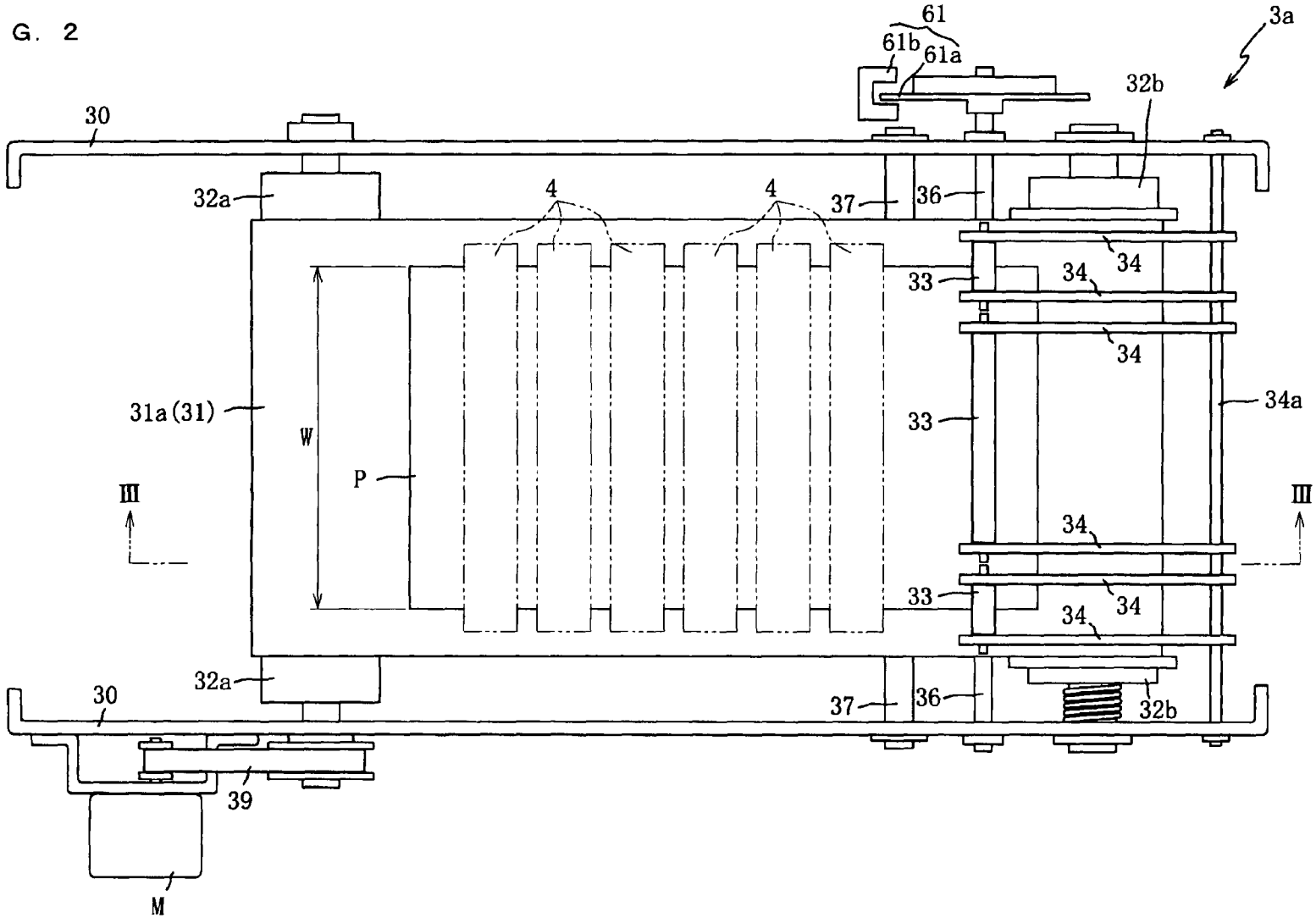
FIG. 2 is a top view of a conveying unit viewed from a recording head side.

Next, detailed configuration of the conveying unit 3*a* is described below with reference to FIG. 2. FIG. 2 is a top view of the conveying unit 3*a* viewed from the recording head 4 side. It should be noted that in FIG. 2, the recording heads 4 are schematically shown using double-dotted dashed lines while the illustration of the compression spring 35*a* for biasing the arm portion 34 is omitted.

The body frame 30 is a member serving as the structural frame of the main body 3. The body frame 30 is fabricated by press working of a metallic material and constructed from a pair of sub-frames arranged such as to oppose to each other with predetermined spacing. As for, the driving roller 32*a*, the driven roller 32*b*, the encoder roller 36, and the tension roller 37 described above, both ends in the axial direction thereof (vertical direction in FIG. 2) are pivotally supported by the body frame 30 in a rotatable manner as shown in FIG. 2.

Further, in the arm portion 34 for pivotally supporting the nip roller 33, a shaft 34*a* is fixed to an end on the opposite side to the nip roller 33 (right side in FIG. 2). The shaft 34*a* is pivotally supported by the body frame in a rotatable manner. Thus, the nip roller 33 can move about the shaft 34*a* toward the encoder roller 36 side (back side of the page surface in FIG. 1) or the opposite (front side of the page surface in FIG. 1).

As shown in FIG. 2, the encoder roller 36 extends in parallel to the nip roller 33, that is, in the width direction of the conveyance belt 31 (vertical direction in FIG. 2). On one side in the axial direction of the encoder roller 36 (upper side in FIG. 2), the rotary encoder 61 is arranged outside the body frame 30.

The rotary encoder 61 detects the rotational position of the encoder roller 36, and comprises a slit plate 61*a* and an optical sensor 61*b*. The slit plate 61*a* is a disk-shaped object fixed to the encoder roller 36, and has a large number of slits formed in the outer edge of the disk-shape object. The optical sensor 61*b* is fixed at a position permitting the detection of the slits of the slit plate 61*a*.

According to the rotary encoder 61, when the conveyance belt 31 rotates, the encoder roller 36 rotates in conjunction with the conveyance belt 31, and so does the slit plate 61*a* fixed to the encoder roller 36. Then, when the slit plate 61*a* rotates by a predetermined angle, the optical sensor 61*b* detects the passage of the slits of the slit plate 61*a*, and thereby outputs its detection signals to a control unit (not shown).

On the basis of the inputted detection signals, the control unit calculates the rotational position of the encoder roller 36 (i.e., conveying speed of the conveyance belt 31), and thereby controls and causes the recording heads 4 to eject ink at ejection timing corresponding to the conveying speed.

On one side in the axial direction of the driving roller 32*a* (lower side in FIG. 2), a transmission belt 39 is connected as shown in FIG. 2. The transmission belt 39 is connected to the rotating shaft of a drive motor M. Thus, when the rotating shaft of the drive motor M rotates, this rotation is transmitted to the driving roller 32*a* via the transmission belt 39 so that the conveyance belt 31 rotates.

As shown in FIG. 2, the tension roller 37 extends in parallel to the driving roller 32*a* and the driven roller 32*b*, that is, in the width direction of the conveyance belt 31 (vertical direction in FIG. 2). As described above, the tension roller 37 is biased by the compression spring 35*b* from the inner periphery surface 31*b* side of the conveyance belt 31 toward the outer periphery surface 31*a* side (see FIG. 1).

Thus, the tension roller 37 is pivotally supported by an opening (not shown) in the shape of an elongate hole, formed in the body frame 30. Accordingly, the tension roller 37 is pivotally supported in a manner permitting a sliding movement toward the biasing direction of the compression spring 35*b* (back side of the page surface in FIG. 2) or the opposite (front side of the page surface in FIG. 2) by using, as the guide, the edges of the opening in the shape of an elongate hole.

Figure 3:
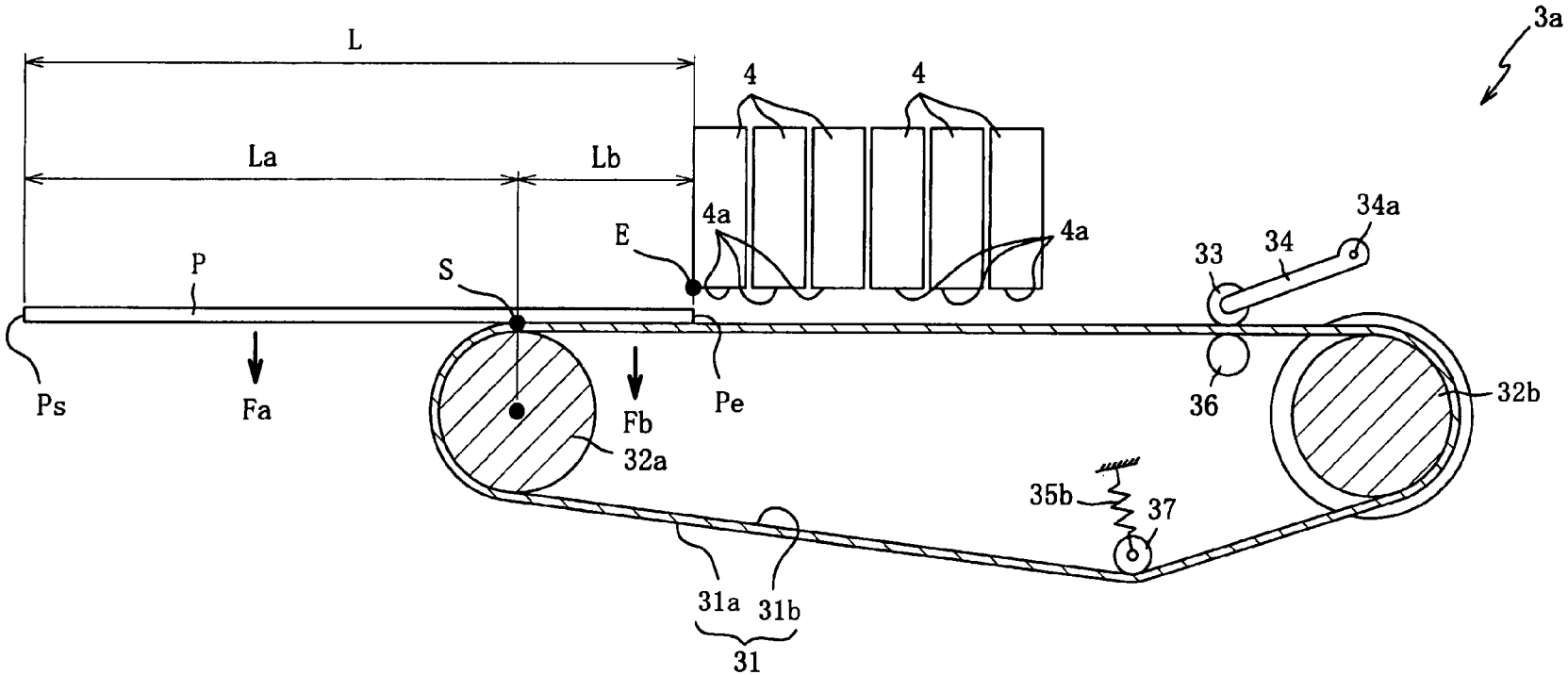
FIG. 3 is a sectional side view of a conveying unit.

Next, paper discharge operation performed when the recording medium P is discharged from the conveying unit 3*a* to the discharge unit 5 is described below with reference to FIG. 3. FIG. 3 is a sectional side view of the conveying unit 3*a* taken along line III-III of FIG. 2. It should be noted that the illustration of the compression spring 35*a* is omitted in FIG. 3.

The recording medium P supplied from the supply unit 2 (see FIG. 1) to the conveying unit 3*a* (conveyance belt 31) is conveyed toward the downstream side in the conveying direction (left side in FIG. 3), and thereby passes through the gap formed between the nozzle surfaces 4*a* of the recording heads 4 and the outer periphery surface 31*a* of the conveyance belt 31. At that time, ink is ejected from the recording heads 4 onto the upper surface of the recording medium P (upper surface in FIG. 3) so that a desired image is formed.

Then, in association with the rotation of the conveyance belt 31, the recording medium P is conveyed further toward the downstream side in the conveying direction (left side in FIG. 3). Then, when the start edge (left edge in FIG. 3) Ps of the recording medium P reaches the separation start position S corresponding to the top of the driving roller 32*a*, the recording medium P naturally separates from the outer periphery surface 31*a* of the conveyance belt 31, while the separated portion (front part in the conveying direction or left part in FIG. 3) protrudes toward the downstream side in the conveying direction (left side in FIG. 3) by virtue of the "elasticity (shape keeping force)" of the recording medium P itself.

Thus, conventional apparatuses have had a problem that the weight of the front part (left part in FIG. 3) of the recording medium P in the conveying direction protruding toward the downstream side in the conveying direction causes the rear part (right part in FIG. 3) of the recording medium P in the conveying direction to separate from the conveyance belt 31 and thereby leap up so that the rear part thereof in the conveying direction contacts with the recording heads 4 (nozzle surfaces 4*a*).

Thus, in the conveying unit 3*a* according to the present embodiment, as shown in FIG. 3, in a state that the termination edge (right edge in FIG. 3) Pe of the recording medium P aligns with the termination edge (left edge in FIG. 3) E of the opposing region between the recording medium P and the recording heads 4 (nozzle surfaces 4*a*), the sticking force Fb exerted from the outer periphery surface 31*a* (sticking layer) of the conveyance belt 31 onto the recording medium P is set to be at least equal to or greater than the weight of a part (i.e., a portion having a length La) of the recording medium P protruding from the termination edge (i.e., separation start position S) of the retaining portion (outer periphery surface 31*a* of the conveyance belt 31, in the present embodiment) that retains the recording medium P, toward the downstream side in the conveying direction (left side in FIG. 3).

By virtue of this configuration, until the termination edge Pe of the recording medium P at least passes the region opposing the recording heads 4 (nozzle surfaces 4*a*), that is, during the time that the rear part (right part in FIG. 3) of the recording medium P in the conveying direction is located in the region opposing the recording heads 4, the sticking force Fb exerted from the conveyance belt 31 (sticking layer) onto the rear part of the recording medium P in the conveying direction can support the weight Fa of a part (front part in the conveying direction; left part in FIG. 3) of the recording medium P protruding from the termination edge (i.e., separation start position S) of the retaining portion.

This prevents that the rear part (right part in FIG. 3) of the recording medium P in the conveying direction separates from the conveyance belt 31 and thereby leaps up, and hence reliably avoids that the rear part of the recording medium P in the conveying direction contacts with the nozzle surfaces 4*a* of the recording heads 4. As a result, such troubles are prevented in advance that an ink blot occurs in the recording medium P and that clogging arises in the nozzles of the nozzle surfaces 4*a*.

Here, the "retaining portion that retains the recording medium" corresponds to the outer periphery surface 31*a* (i.e., conveyance surface) of the conveyance belt 31 in the present embodiment. The "termination edge of the retaining portion" corresponds to the separation start position S where the recording medium P starts to separate from the conveyance belt 31.

As such, when the termination edge of the retaining portion is set to be the separation start position S, this configuration avoids the necessity of an additional member (for example, a pair of roller members for nipping and conveying the recording medium P, or a conveyance chute for supporting the recording medium P in a contacting manner) for conveying the recording medium P to the discharge unit 5 in such a manner that the rear part (right part in FIG. 3) of the recording medium P in the conveying direction should be prevented from contacting with the recording heads 4 (nozzle surfaces 4*a*). This reduces the number of components, and hence reduces the component cost and the assembling cost.

Figure 4:
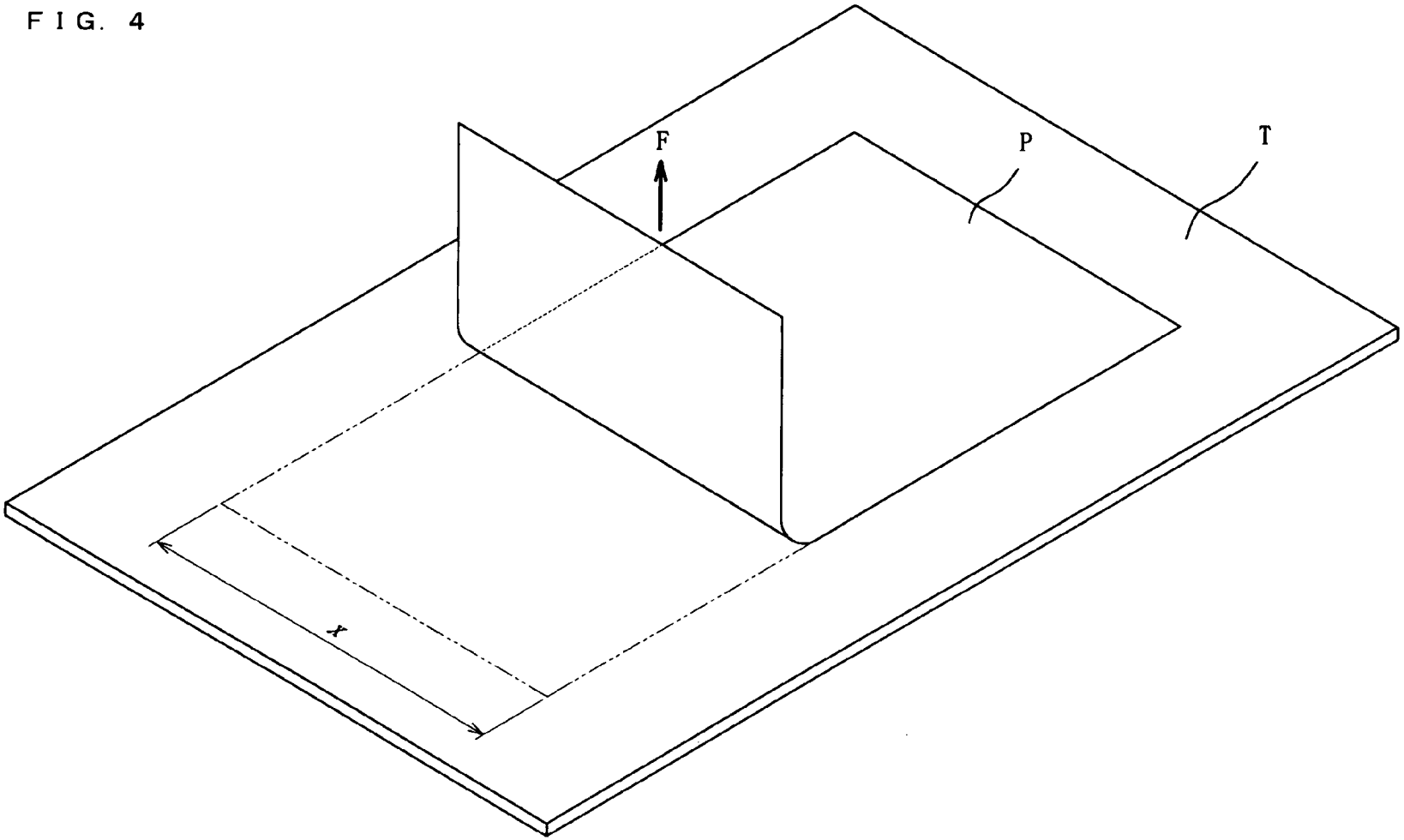
FIG. 4 is a perspective view schematically showing a method of peeling strength test.

Next, the relation between the sticking force Fb generated by the conveyance belt 31 and the spacing distance from the termination edge E to the separation start position S is described below with reference to FIGS. 3 and 4. FIG. 4 is a perspective view schematically showing a method of peeling strength test.

Here, the recording medium P is formed in a rectangular shape in a front view (see FIG. 2). As shown in FIG. 3, the length dimension in the conveying direction (horizontal direction in FIG. 3) is denoted by L, while the width dimension in a direction perpendicular to the conveying direction is denoted by W (see FIG. 2), and while the weight per unit area is denoted by ρ.

First, the peeling strength test is described below. The peeling strength test is a test for measuring the force necessary when the recording medium P is peeled off from the conveyance belt 31. As shown in FIG. 4, the recording medium P having a width dimension x is peeled off from a sticking-layer equivalent member T at an angle of 90 degrees. Then, the force F necessary for this peeling off is measured.

In the present embodiment, the sticking force Fb exerted from the conveyance belt 31 (sticking layer) onto the recording medium P is assumed to be expressed by $Fb=F\cdot W/x$ on the basis of the force F acquired by the peeling strength test.

Here, the sticking layer formed on the sticking-layer equivalent member T has the same physical properties as the sticking layer formed on the outer periphery surface 31*a* of the conveyance belt 31. Further, in order to reproduce the state that the recording medium P is nipped between the nip roller 33 and the encoder roller 36, the peeling strength test is performed after the recording medium P is pressed against the sticking-layer equivalent member T at a predetermined pressure.

On the other hand, the weight Fa of a part of the recording medium P protruding from the separation start position S toward the downstream side in the conveying direction (left side in FIG. 3) is expressed by $Fa=\rho\cdot W\cdot La$, since the protruding length of the recording medium P is La in the state shown in FIG. 3, that is, in a state that the termination edge Pe of the recording medium P aligns with the termination edge E of the region opposing the recording heads 4 (nozzle surfaces 4*a*).

Thus, when the conveying unit 3*a* (the physical properties of the sticking layer, the distance from the termination edge E to the separation start position S, and the like) is constructed such that the weight Fa should be greater than the above-mentioned sticking force Fb (Fa>Fb), that is, such that the relation $F\cdot W/x>\rho\cdot W\cdot La$ should be satisfied, the situation can be prevented that the weight of the front part (left part in FIG. 3) of the recording medium P in the conveying direction causes the rear part (right part in FIG. 3) of the recording medium P in the conveying direction to separate from the conveyance belt 31 and thereby leap up, at least until the termination edge Pe of the recording medium P passes the termination edge E of the region opposing the recording heads 4. This reliably avoids that the rear part of the recording medium P in the conveying direction contacts with the nozzle surfaces 4*a* of the recording heads 4.

Figure 5:
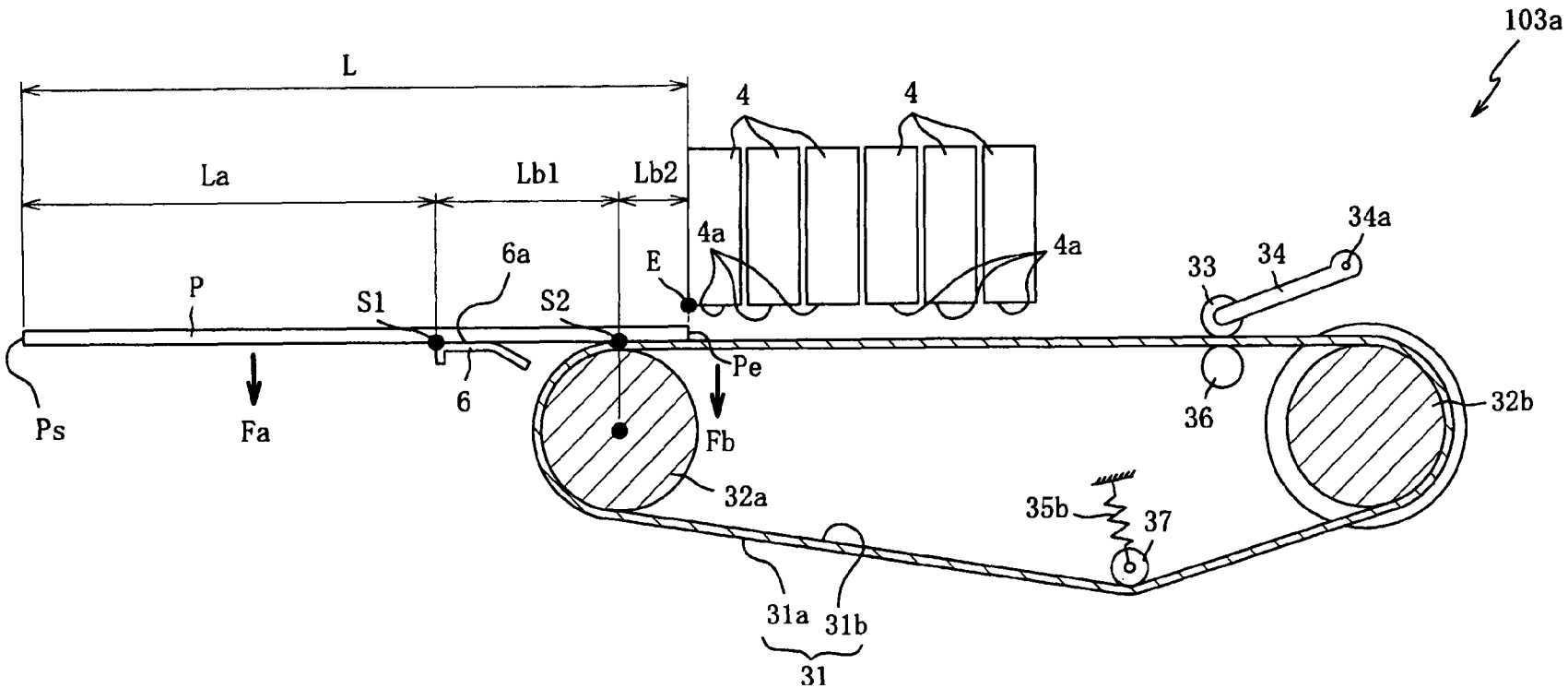
FIG. 5 is a sectional side view of a conveying unit according to a second embodiment.

Next, a second embodiment is described below with reference to FIG. 5. FIG. 5 is a sectional side view of a conveying unit 103*a* according to a second embodiment, and corresponds to a sectional side view taken along line III-III of FIG. 2.

The first embodiment has been described for the case that the recording medium P is directly discharged from the conveyance belt 31 to the discharge unit 5. In contrast, in the second embodiment, a conveyance chute 6 is arranged on the downstream side in the conveying direction of the conveyance belt 31, so that the recording medium P discharged to the discharge unit 5 is supported by the conveyance chute 6. Here, like components to the first embodiment are designated by like numerals, and hence their description is omitted.

As shown in FIG. 5, a conveyance chute 6 is arranged on the downstream side in the conveying direction of the conveyance belt 31 (left side in FIG. 5). The conveyance chute 6 has an upper surface (upper surface in FIG. 5) serving as a contact surface 6*a* for contacting with the recording medium P, so that the contact surface 6*a* supports the recording medium P discharged from the conveyance belt 31 to the discharge unit 5 (see FIG. 1).

In the conveying unit 103*a* according to the present embodiment, in a state that the termination edge Pe of the recording medium P aligns with the termination edge E of the opposing region between the recording medium P and the recording heads 4 (nozzle surfaces 4*a*) as shown in FIG. 5, the sticking force Fb exerted from the outer periphery surface 31*a* (sticking layer) of the conveyance belt 31 onto the recording medium P is set to be at least equal to or greater than the weight of a part (i.e., a portion having a length La) of the recording medium P protruding from the termination edge (i.e., separation start position S1) of the retaining portion (the outer periphery surface 31*a* of the conveyance belt 31 and the contact surface 6*a* of the conveyance chute 6, in the present embodiment) that retains the recording medium P, toward the downstream side in the conveying direction (left side in FIG. 5).

By virtue of this configuration, until the termination edge Pe of the recording medium P at least passes the region opposing the recording heads 4 (nozzle surfaces 4*a*), that is, during the time that the rear part (right part in FIG. 3) of the recording medium P in the conveying direction is located in the region opposing the recording heads 4, the sticking force Fb exerted from the conveyance belt 31 (sticking layer) onto the rear part of the recording medium P in the conveying direction can support the weight Fa of a part (front part in the conveying direction; left part in FIG. 5) of the recording medium P protruding from the termination edge (i.e., separation start position S1) of the retaining portion.

As a result, similarly to the first embodiment described above, the rear part (right part in FIG. 5) of the recording medium P in the conveying direction is prevented from separating from the conveyance belt 31 and thereby leaping up. This reliably avoids that the rear part of the recording medium P in the conveying direction contacts with the nozzle surfaces 4*a* of the recording heads 4. As a result, such troubles are prevented in advance that an ink blot occurs in the recording medium P and that clogging arises in the nozzles of the nozzle surfaces 4*a*.

Here, the "retaining portion that retains the recording medium" corresponds to the outer periphery surface 31*a* (i.e., conveyance surface) of the conveyance belt 31 and the contact surface 6*a* of the conveyance chute 6 in the present embodiment. The "termination edge of the retaining portion" corresponds to the separation start position S1 where the recording medium P starts to separate from the conveyance chute 6, that is, the termination edge of the contact surface 6*a* of the conveyance chute 6.

As such, when the termination edge of the retaining portion is constructed to be the termination edge of the contact surface 6*a* of the conveyance chute 6, the conveyance chute 6 retains the recording medium P on the downstream side in the conveying direction (i.e., downstream side of the separation start position S2) relative to the conveyance belt 31 as shown in FIG. 5. This alleviates the situation that the weight of the front part (left part in FIG. 5) of the recording medium P in the conveying direction acts as a force causing the rear part (right part in FIG. 5) of the recording medium P in the conveying direction to separate from the conveyance belt 31 (sticking layer).

This allows the area of the sticking layer to be reduced. That is, the length in the conveying direction (horizontal direction in FIG. 5) of the conveyance belt 31 (the distance between the driving roller 32*a* and the driven roller 32*b*) can be reduced. This permits easy suppression of vibrations in the conveyance belt 31, and hence improves the image quality.

Here, in the present embodiment as shown in FIG. 5, the contact surface 6*a* of the conveyance chute 6 and the conveyance surface of the conveyance belt 31 are aligned with each other with respect to the levels thereof (vertical direction in FIG. 5). That is, the contact surface 6*a* and the conveyance surface are located approximately in plane with each other. This suppresses more reliably that the rear part (right part in FIG. 5) of the recording medium P in the conveying direction separates from the conveyance belt 31.

That is, if a level difference (difference in the positions in the vertical direction in FIG. 5) were present between the contact surface 6*a* of the conveyance chute 6 and the conveyance surface of the conveyance belt 31, owing to the level difference (that is, if the contact surface 6*a* of the conveyance chute 6 were located above the conveyance surface of the conveyance belt 31 (upward in FIG. 5), the recording medium P would be lifted up at the separation start position S2, while if the contact surface 6*a* were located below the conveyance surface (downward in FIG. 5), a rotational moment in a counterclockwise direction in FIG. 5 would act on the recording medium P), a load in a separating direction from the sticking layer of the conveyance belt 31 would act on the rear part of the recording medium P in the conveying direction.

In contrast, when the contact surface 6*a* and the conveyance surface are arranged in plane with each other so that a level difference is avoided as in the present embodiment, a load is suppressed that could cause the rear part of the recording medium P in the conveying direction to separate from the sticking layer.

Next, the relation between the sticking force Fb generated by the conveyance belt 31 and the spacing distance from the termination edge E to the separation start position S1 (and the separation start position S2) is described below.

Here, the recording medium P is constructed similarly to that of the first embodiment described above. Further, the peeling strength test is also performed similarly. Thus, the sticking force Fb exerted from the conveyance belt 31 (sticking layer) onto the recording medium P is expressed by $Fb=F\cdot W/x$.

On the other hand, the weight Fa of a part of the recording medium P protruding from the separation start position S1 toward the downstream side in the conveying direction (left side in FIG. 5) is expressed by $Fa=\rho\cdot W\cdot La$, since the protruding length of the recording medium P is La in the state shown in FIG. 5, that is, in a state that the termination edge Pe of the recording medium P aligns with the termination edge E of the region opposing the recording heads 4 (nozzle surfaces 4*a*).

Thus, when the conveying unit 103*a* (the physical properties of the sticking layer, the distance from the termination edge E to the separation start position S1 (and the separation start position S2), and the like) is constructed such that the weight Fa should be greater than the above-mentioned sticking force Fb ($Fa>Fb$), that is, such that the relation $F\cdot W/x>\rho\cdot W\cdot La$ should be satisfied, the situation can be prevented that the weight of the front part (left part in FIG. 5) of the recording medium P in the conveying direction causes the rear part (right part in FIG. 5) of the recording medium P in the conveying direction to separate from the conveyance belt 31 and thereby leap up, at least until the termination edge Pe of the recording medium P passes the termination edge E of the region opposing the recording heads 4. This reliably avoids that the rear part of the recording medium P in the conveying direction contacts with the nozzle surfaces 4*a* of the recording heads 4.

Although the configuration has been described and illustrated on the basis of the embodiments, it can be readily understood that it is not limited to the above-mentioned embodiments, and numerous modifications and variations can be devised without departing from the scope.

For example, the above-mentioned embodiments have been described for the case that the outer periphery surface 31*a* of the conveyance belt 31 is subjected to silicone treatment so that the sticking layer is formed. However, it is not necessarily limited to this method. That is, another method may be employed. Employable methods include an electrostatic adsorption method and a vacuum adsorption method.

As an example in the second embodiment, the end (opposite side to the separation start position S1) of the conveyance chute 6 has been arranged at a position distant from the conveyance belt 31. However, the end of the conveyance chute 6 may contact with the outer periphery surface 31*a* of the conveyance belt 31, and thereby serve also as a separation claw for separating the recording medium P from the outer periphery surface 31*a* of the conveyance belt 31.

As an example, the above-mentioned embodiments have been described in case of applying to a line type printer. However, it is not necessarily limited to this method. The present embodiment may be applied to a serial type printer for ejecting ink when the recording head performs reciprocating motion in the main scanning direction perpendicular to the conveying direction for the recording medium. In a printer of this method, the recording head may be retracted to an end part of the main scanning direction when the rear part of the recording medium in the conveying direction separates from the conveyance belt and thereby leaps up. This approach can avoid that the rear part of the recording medium contacts with the recording head. Nevertheless, in a case that recording is to be performed successively on a plurality sheets of recording media, the recording head cannot be retracted because recording need be performed on the subsequent recording medium. Accordingly, the effective application is possible.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus, comprising:

an endless conveyance belt having an outer periphery surface which serves as a conveyance surface for a recording medium; and a recording head for ejecting ink onto a recording medium from a nozzle surface opposing the conveyance surface of said conveyance belt, wherein a recording medium retained on the conveyance surface of said conveyance belt is discharged to a discharge unit by means of a conveyance force thereof, a sticking layer for sticking to the recording medium is formed on the outer periphery surface of said conveyance belt, and until a leading edge and a termination edge opposite the leading edge of the recording medium conveyed on said conveyance belt passes a region opposing the nozzle surface of said recording head, a sticking force exerted from the sticking layer of said conveyance belt onto the recording medium is set to be greater than the weight of a part of the recording medium protruding from a termination edge of a retaining portion that retains the recording medium, to downstream side in a conveying direction, wherein $$F*W/x>\rho*W*La$$

is satisfied when said sticking force is defined by $$F*W/x$$

while said weight is defined by $$\rho*W*La,$$

where

F: force necessary when a test recording medium having a width dimension x is peeled off from said sticking layer at an angle of 90 degrees, W: width dimension of said recording medium in a direction perpendicular to said conveying direction, ρ: weight of said recording medium per unit area, and La: length of a part of the recording medium protruding from the termination edge of said retaining portion toward the downstream side in the conveying direction in a state that the termination edge of said recording medium aligns with the termination edge of the region opposing the nozzle surface of said recording head.

2. The image forming apparatus according to claim 1, wherein the termination edge of the retaining portion that retains the recording medium is a position where said recording medium starts to separate from said conveyance belt.

3. The image forming apparatus according to claim, further comprising a conveyance chute that has an upper surface serving as a contact surface for contacting with the recording medium and supports the recording medium discharged from said conveyance belt to the discharge unit, wherein the termination edge of the retaining portion that retains the recording medium is a termination edge of said contact surface of said conveyance chute.

4. The image forming apparatus according to claim 3, wherein the contact surface of said conveyance chute is located approximately in plane with the conveyance surface of said conveyance belt.

* * * * *